United States Patent [19]

Argazzi

[11] 4,353,325

[45] Oct. 12, 1982

[54] SEALANT APPLYING APPARATUS

[75] Inventor: Dennis J. Argazzi, Newington, Conn.

[73] Assignee: Loctite Corporation, Newington, Conn.

[21] Appl. No.: 306,351

[22] Filed: Sep. 28, 1981

[51] Int. Cl.[3] ..... B05B 13/02

[52] U.S. Cl. ..... 118/683; 118/109; 118/110; 118/319; 118/321

[58] Field of Search ..... 118/683, 109, 110, 319, 118/320, 321, 500

[56] References Cited

U.S. PATENT DOCUMENTS

| | | | |
|---|---|---|---|
| 3,390,661 | 7/1968 | Wrench | 118/58 |
| 3,819,403 | 6/1974 | Hogstrom | 118/302 |
| 4,046,106 | 9/1977 | Bowman | 118/230 |
| 4,207,832 | 6/1980 | Bowman | 118/230 |

*Primary Examiner*—Bernard D. Pianalto

*Attorney, Agent, or Firm*—Watson, Cole, Grindle & Watson

[57] ABSTRACT

An apparatus for coating the threads of articles such as fasteners, pipes, plugs, valves, fittings, etc., includes an indexing table for intermittently moving the articles along an arcuate path, rotatable article spindle assemblies on the table radially spaced apart an equal distance and being stopped at a dispensing station and at a wiping station spaced therefrom equal to such distance. A dispensing head at the dispensing station includes a nozzle for delivering a coating of the sealant onto the threads of a rotating articles, and a wiper wheel at the wiping station wipes the coated threads and presses the coated sealant into the thread roots during rotation of the wheel which likewise rotates the coated articles.

10 Claims, 7 Drawing Figures

SEALANT APPLYING APPARATUS

RELATED APPLICATIONS

This application relates to U.S. application Ser. No. 202,418, filed Oct. 30, 1980, and entitled "Liquid Dispensing Apparatus."

BACKGROUND OF THE INVENTION

This invention relates generally to an apparatus for applying sealant to the threads of articles, such as fasteners, pipes, particularly to such an apparatus capable of pressing the sealant into the thread roots of the coated articles to completely fill the area where most leaks occur when used in a wide variety of applications.

Sealants of various types are available as preapplied coatings for locking and sealing together threaded parts. One such family of sealants or adhesives is dry to the touch and contains microcapsules of liquid anaerobic (curing in the absence of air) adhesive. During installation of a threaded article coated with this structural adhesive, liquid resin is released from its protective capsule to quickly fill the voids between the mating threads. Upon curing, a tough adhesive bond is formed between the male and female elements. The assembly is thus securely locked and sealed, or "unitized." These and other types of adhesives can be preapplied to parts long before they are used. If properly applied, the particular sealant blocks leakages in threaded joints which can be loosened, tightened and retightened without affecting the seal, and the sealant and can be reused several times on joints without recoating.

Such preapplied sealant and adhesive coatings have been applied on-the-job by manually brushing, dipping, spraying, swabbing, or roll coating, all of which are time consuming, messy and ineffective in assuring that the coating material is sufficiently pressed into the thread roots to provide a consistent leak-proof coating of the threaded parts. If voids or bubbles occur at the thread roots during coating application, leakages are apt to occur through the locked and sealed joint.

SUMMARY OF THE INVENTION

It is therefore an object of the present invention to provide an apparatus for applying sealants to the threads of articles in a simple, economical and highly efficient manner which assures consistent leak-proof coatings of threadedly joined parts.

Another object of this invention is to provide such an apparatus which includes an article support for incrementally moving a plurality of articles along an arcuate path, rotatable article spindle assemblies on the support being spaced apart a predetermined distance and being stopped at a dispensing station and at a wiping station which are likewise spaced apart such predetermined distance. A dispensing nozzle adjacent the path at the dispensing station dispenses a coating of sealant onto the threads of each article stopped thereat, and a wiper wheel at the wiping station wipes the coated threads and presses the coated sealant into the thread roots, the wiper wheel being rotatable and including a peripheral wiper surface.

A further object of the present invention is to provide such an apparatus wherein each spindle assembly is rotated at the dispensing station to effect a coating of sealant along at least a portion of the thread circumference, and preferably along the entire circumference.

A still further object of this invention is to provide such an apparatus wherein each spindle assembly is rotated by a rotatable magnetic disc which transmits the rotation via magnetic atttraction with another magnetic disc associated with each spindle assembly.

A still further object of this invention is to provide such an apparatus wherein a dispensing pump is provided for feeding sealant to the nozzle, and a switch actuates the dispensing of sealant before each spindle assembly is stopped at the dispensing station. Such a switch may be in the form of a switch arm extending into the arcuate path for actuation by each article as it approaches the dispensing station.

Other objects, advantages and novel features of the invention will become more apparent from the following detailed description of the invention when taken in conjunction with the accompanying drawings.

DETAILED DESCRIPTION OF THE INVENTION

Figure 1:
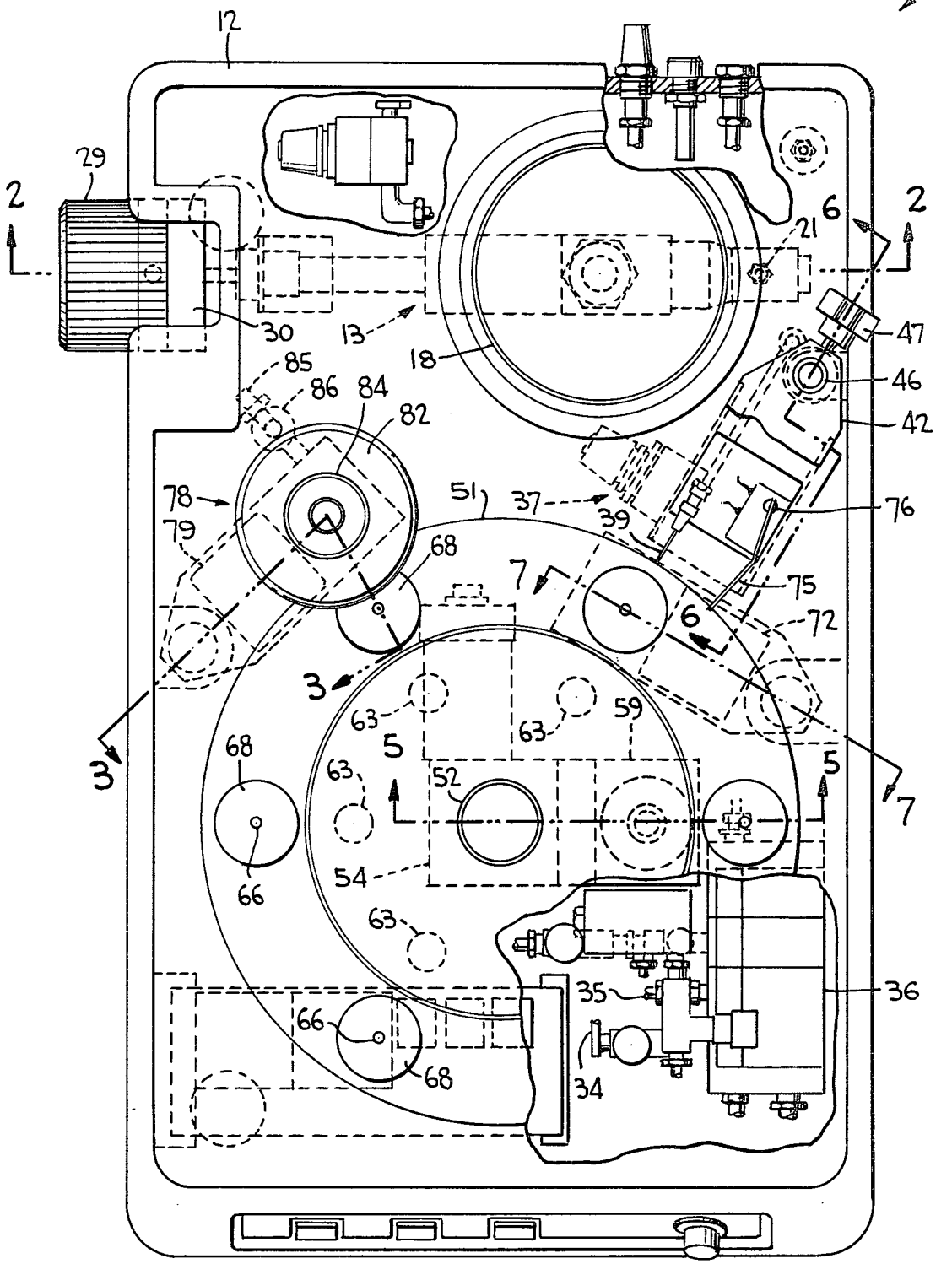
FIG. 1 is a schematic top plan view of the sealant applying apparatus according to the invention.
Figure 2:
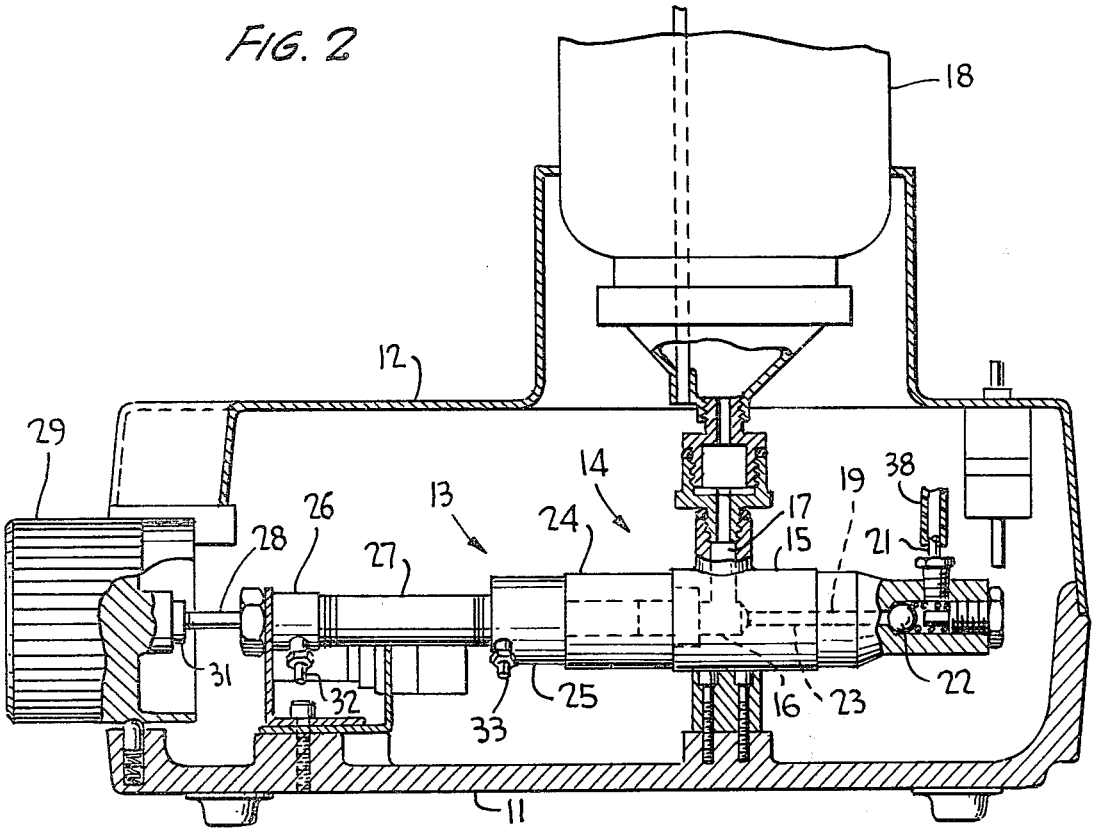
FIG. 2 is a sectional view, at a slightly enlarged scale, taken substantially along the line 2—2 of FIG. 1, showing the dispensing pump and the sealant supply container.

Turning now to the drawings wherein like reference characters refer to like and corresponding parts throughout the several views, the sealant applying apparatus is generally designated 10 in FIG. 1 and includes a base 11 (FIG. 2) adapted to rest on a table or the like, and a removable cover 12 attached thereto. A dispensing pump assembly 13, shown in detail in FIG. 2, is mounted on base 11 and is similar to the liquid dispensing apparatus of the aforementioned U.S. Ser. No. 202,418, the entire disclosure thereof being specifically incorporated herein by reference. Thus, the pump assembly comprises a piston and cylinder unit 14 which includes a housing 15 containing a cavity 16 having a product inlet bore 17 in communication with the outlet of a supply container 18 for the sealant or adhesive to be coated on to the threads of articles in a manner to be described in more detail hereinafter. Housing 15 also includes a pump cylinder defined by a bore 19 extending from the cavity and terminating in a pump outlet 21 controlled by a spring loaded ball check valve 22. A piston or plunger rod 23, shown in its retracted position in FIG. 2, extends rearwardly through a seal ring and an O-ring located at the central opening of a support element 24 containing a collar mounted on the piston rod which is guided along a longitudinal track to prevent piston rod rotation during its longitudinal adjustment, all as in the same manner set forth in the aforementioned application. The piston also extends rearwardly through connector element 25 and 26 attached to opposite ends of an air cylinder 27, the piston rod terminating in a threaded end 28. The stroke of the piston rod 23 is adjusted by a rotatable dispense knob 29 extending outwardly of the base and cover, the knob engaging a threaded sleeve 31 secured to the piston rod. This sleeve engages internal threads on the knob so that upon knob rotation, the piston rod displacement may be accordingly increased or decreased. A graduated scale 30 may be provided for indicating rod displacement, and thus the amount of sealant to be dispensed, by matching an indicator line on the knob with one of the graduations.

Figure 6:
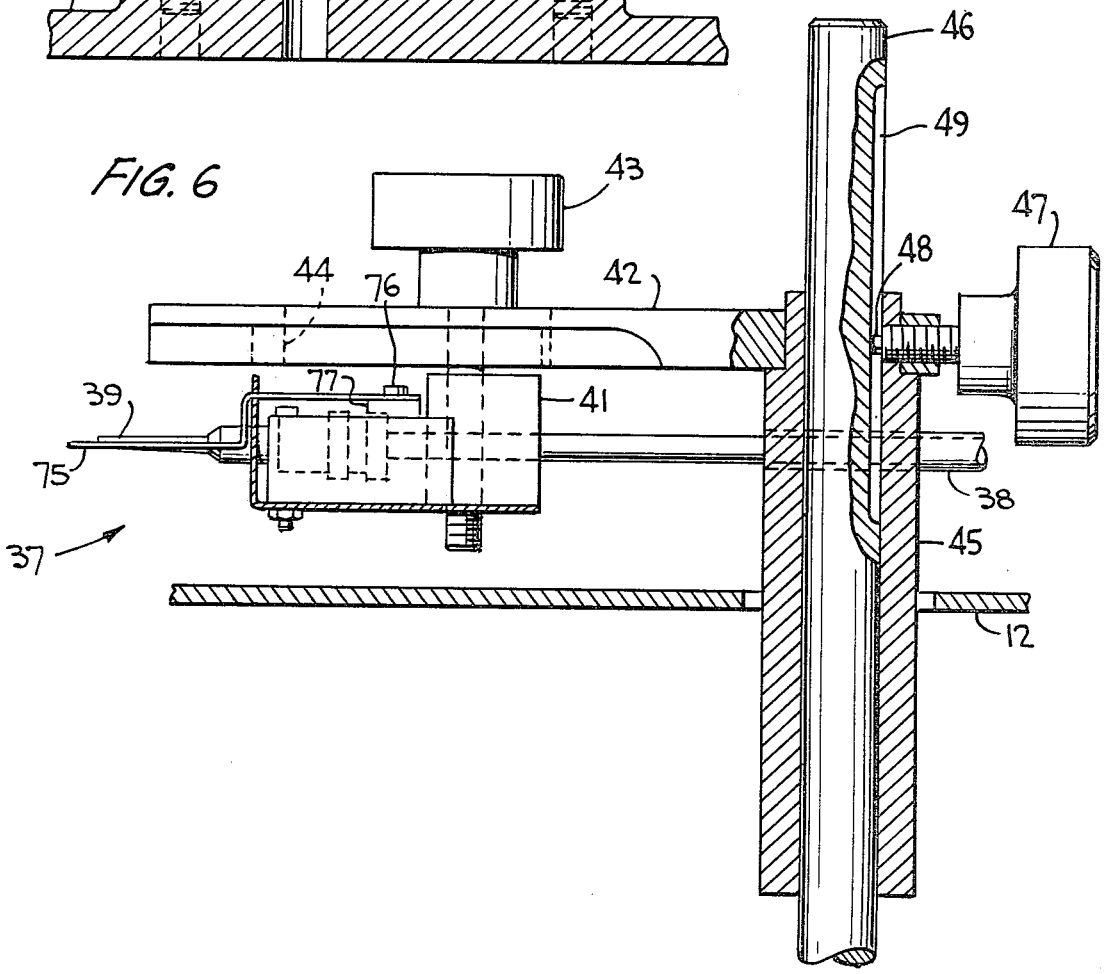
FIG. 6 is a sectional view showing the dispensing nozzle, taken substantially along the line 6—6 of FIG. 1.

Air pressure lines (not shown) interconnect respectively with air ports 32,33 respectively connected as at 34,35 with a solenoid assembly 36 (FIG. 1). Thus, pressurized air admitted to port 32 extends the piston while at the same time exhausting pressurized air through port 33, and vice-versa for retracting the piston. During outward displacement of the piston sealant is discharged through outlet 21 and into a dispensing head assembly 37 (FIG. 6) via a tubing 38. This assembly, positioned at a dispensing station, comprises a dispense nozzle 39 overlying cover plate 12 and is mounted via a block 41 on a horizontal support 42 through an adjusting knob 43. Support 42 has an elongated opening 44 to facilitate longitudinal adjustment of the nozzle toward and away from the threaded article to be coated. And, support 42 is mounted on a sleeve 45 surrounding a vertical support rod 46 extending from base 11 through the cover. An adjustment knob 47 on the sleeve has its tip 48 in engagement with a vertical groove 49 on the support rod to facilitate adjustment of the nozzle along a vertical axis. And, the dispensing head assembly may be adjustable about the axis of rod 46 upon the movement of sleeve 45.

Figure 5:
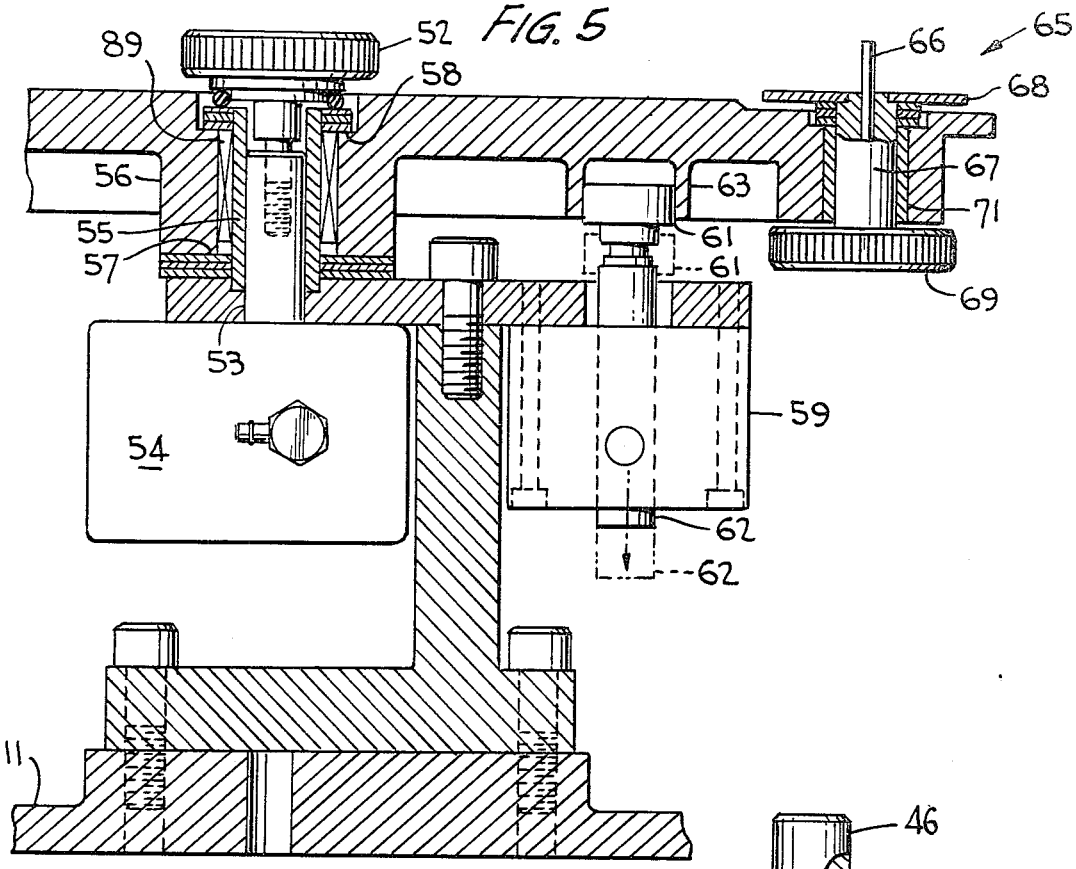
FIG. 5 is a sectional view of a portion of the rotatable worktable including a typical spindle assembly, taken substantially along the line of 5—5 of FIG. 1.

An article carrier in the form of an indexable worktable 51 (FIGS. 1 and 5) is removable mounted on base 11 by a table locking knob 52 threaded into a central axle 53 extending from a rotary actuator 54. A sleeve 55 frictionally engages axle 53 for rotation thereof, and a central hub 56 surrounds the sleeve. Lower and upper thrust bearing 57 and 58 are provided between the sleeve and the hub, as well as a combined bearing and over-running clutch 59. The entire worktable may thus be removed for maintenance and cleaning upon the removal of locking knob 52. Rotary actuator mechanism 54 comprised of a clevis mounted air cylinder operatively connected to a pivot arm on the worktable axle, is operatively connected with the solenoid assembly as is an actuator 89 having a positioning detent 61 at the upper end of a piston 62 movable between its solid outline and phantom outline positions of FIG. 5. The rotary actuator is designed to rotate its axle or driven shaft 53 counterclockwise (when viewed from the top in FIG. 5) through 60° whereupon rotation stops and is rotated clockwise through 60° whereupon it again stops and the cycle is repeated. Each such counterclockwise rotation is transmitted through over-running clutch 59 to the worktable to effect a rotary movement thereof through 60°. The worktable is retained and precisely located at its stopped position by the engagement between detent 61 and the inner surface of a tapered locating wall cavity 63 recessed into the underside of the worktable. Six of such wall cavities, radially spaced apart 60°, are provided (FIG. 1). Piston 62 is extended to its FIG. 5 position upon actuation of actuator 59 from the solenoid assembly, whereupon positioning detent 61 is moved into the depression formed by wall cavity 63. At the end of the article dispensing operation, to be described hereinafter, piston 62 is retracted upon a signal received from the solenoid assembly thereby shifting disc 61 out of engagement to its phantom outline position. In the meantime, shaft 53 returns to its initial position upon clockwise movement through 60° while the worktable is stopped. Bearings 57, 58 and 59 facilitate such return movement unimpeded by the worktable.

A plurality of spindle assemblies 65 (six shown in FIG. 1) are radially spaced apart 60° adjacent the periphery of the worktable. Each such assembly includes a vertical spindle 66 extending outwardly of a stud 67 and having a horizontal spindle disc 68 attached to the stud. A disc 69 of magnetic material is secured to the underside of the stud. And, the stud is rotatable about its central axis within a surrounding bearing 71.

Figure 7:
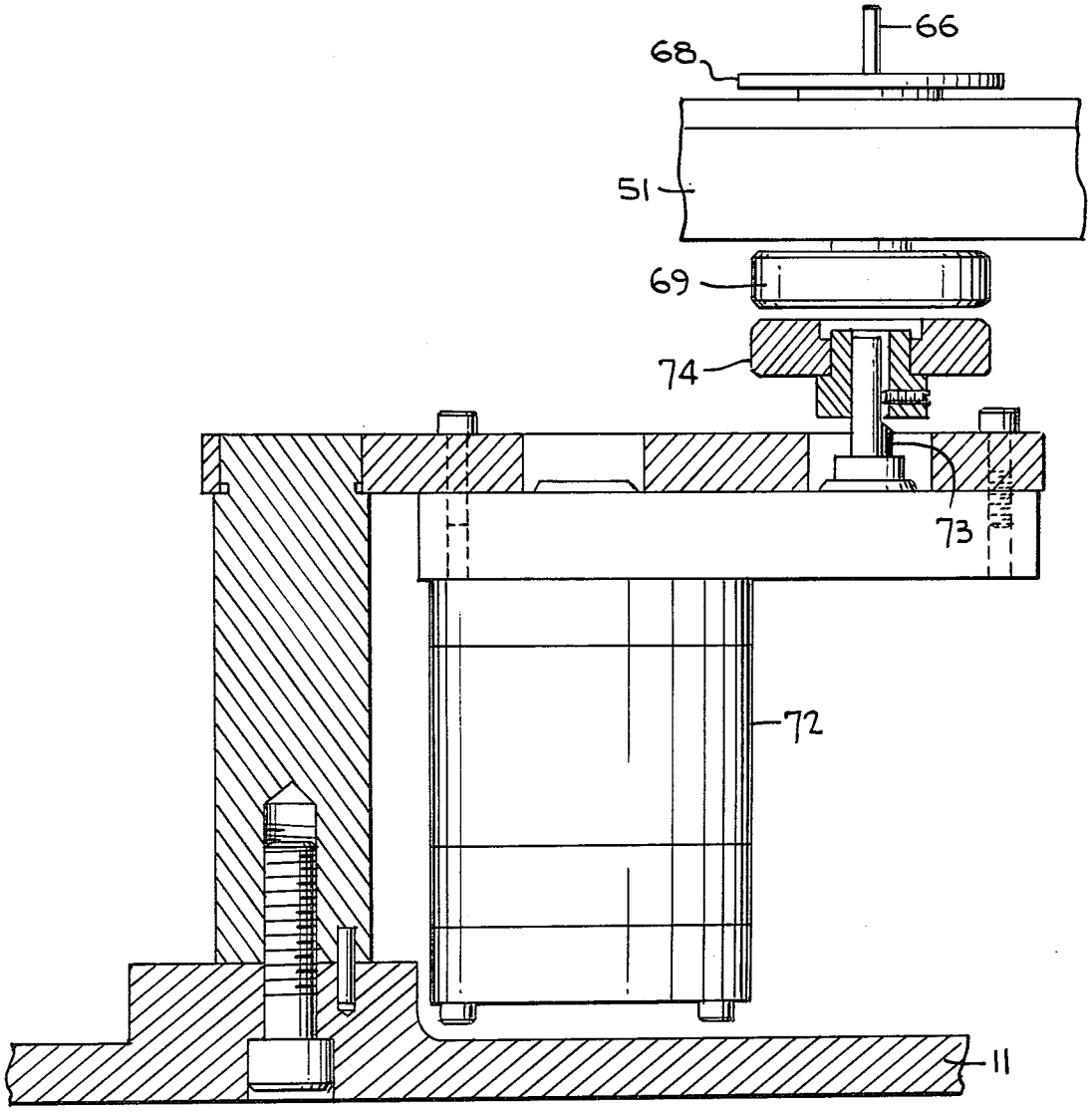
FIG. 7 is a sectional view of the rotary mechanism for rotating each spindle assembly at the dispensing station, taken substantially along the line 7—7 of FIG. 1.

Beneath the worktable and mounted on base 11 is a motor 72 (FIG. 7) operatively connected with the solenoid assembly and having a drive spindle 73 on which a drive magnetic disc 74 is securely mounted. As shown, discs 69 and 74 are spaced apart a slight distance when each spindle assembly is intermittently stopped at the dispensing station. Thus, rotation of the drive magnetic disc transmits that rotation to magnetic disc 69 via magnetic attraction for rotating the spindle assembly a predetermined amount during the dispensing of sealant on to the threads of an article A (FIG. 3) supported on spindle 66.

The pump plunger in assembly 13 is actuated by the movement of a switch arm 75 (FIGS. 1 and 6) pivotally mounted as at 76 on a block 77 made part of the dispensing head assembly. The switch is connected into the electrical system of the apparatus for operating the pump plunger via the solenoid assembly as the switch arm is tripped by the article to be coated during the movement along its path into the dispensing station. The switch arm therefore extends toward the worktable and into the path of travel of the articles to be coated.

Figure 3:
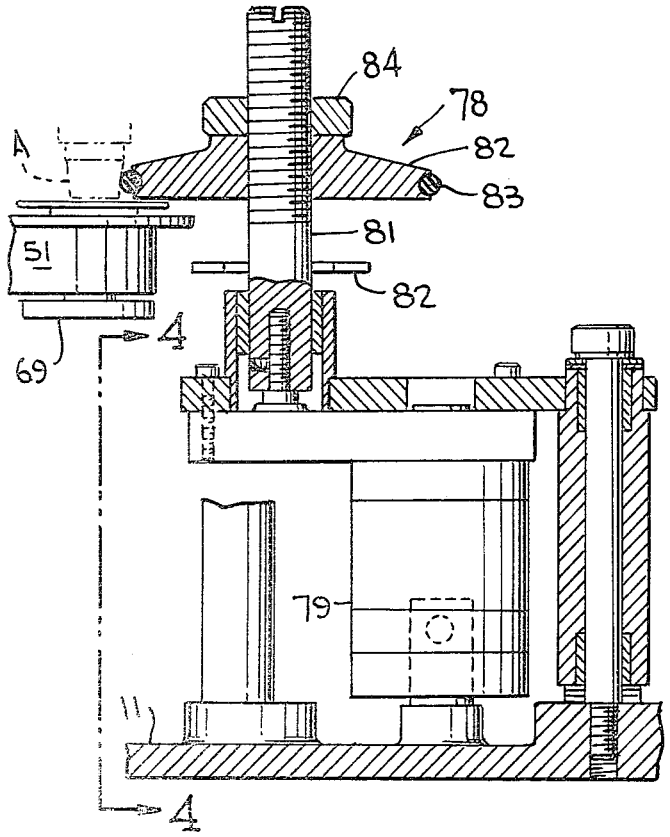
FIG. 3 is a cross-sectional view of the wiper assembly taken substantially along the line 3—3 of FIG. 1.
Figure 4:
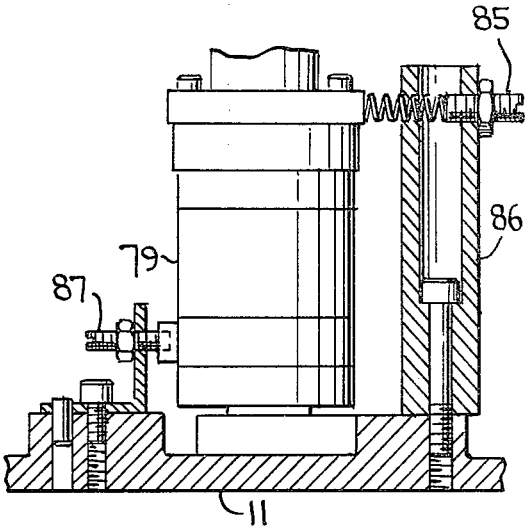
FIG. 4 is a side elevational view of the motor and support for the wiper assembly, taken along the line 4—4 of FIG. 3.

In accordance with the invention the coated threads of each article are wiped and the applied coatings are pressed into the thread roots by the provision of a wiper assembly 78, shown in FIGS. 1 and 3, located at a wiping station radially spaced 60° from the dispensing station. A motor 79 is mounted on base 11 and its output drive spindle supports an externally threaded stud 81 for the rotation thereof upon motor actuation. This stud forms a part of the wiper assembly and extends outwardly of cover 12. A wiper wheel 82, having a resilient belt 83 mounted along the periphery, is threaded on to stud 81 and is locked into a predetermined position therealong by a lock nut 84. Belt 83 and dispensing nozzle 39 lie at substantially the same elevation to assure a wiping of all the coated threads and a pressing of the coated sealants into the thread roots to fill all the voids. Belt 83 may be of a plastic material or the like which becomes surface-saturated with sealant for effectively performing its wiping and pressing functions. And, depending on the size of the articles to be coated, wiper wheel assembly 78 may be adjusted toward and away from spindle 66 supporting article A by axially rotating motor 79 about the support rod which supports the wiper assembly. As shown in FIGS. 1 and 4, a spring bias upper set screw 85 mounted on a post 86 is provided for the adjustment together with a bottom set screw (FIG. 4) 87.

In setting up the present apparatus for dispensing, the proper tooling pieces (not shown) are selected for the parts to be coated and are press fitted over spindles 66 of the indexing table. Articles A to be coated are placed over the tooling pieces which are, of course, appropriately selected for fasteners, pipes, plugs, valves, fittings, etc.

The height of dispensing head assembly 37 is adjusted by loosening knob 47 at the back of the head, raising or lowering the head until nozzle 39 points approximately one thread above the center of the threads to be coated, and retightening the knob. Knob 43 on the top of the dispensing head is then loosened and the head is slid in or out until nozzle 39 is approximately 1/16 inch from the article to be coated at the dispensing station.

The appropriate wiping roller 82 is selected depending on the size of the article to be coated. This wiper wheel is then threaded down over threaded stud 81 until the bottom of the wheel lies at approximately the third thread of the article, after which the wiper wheel is locked in place by lock nut 84.

The dispense control knob 29 of pump assembly 13 is then turned to its minimum setting.

It should be pointed out that the articles to be coated may be either manually or automatically loaded and/or unloaded in place without departing from the invention. After setting up the apparatus as aforedescribed, an electrical power switch (not shown) is turned on whereupon the article to be coated at the dispensing station commences rotation as the magnetic disc 74 transmits its rotation via magnetic attraction to the overlying magnetic disc 69 associated with the spindle assembly. Also, the threaded article at the wiping station will begin to rotate as it is turned by the wiper wheel.

An indexing speed is chosen to comfortably allow the operator to load and unload the threaded articles or to permit some suitable automated loading and unloading equipment to function.

As each threaded article approaches the dispensing station, it trips switch arm 75 as it moves thereagainst for actuation of the pump plunger which dispenses a quantity of sealant through nozzle 39 after a predetermined electronic delay, on to the threads of the article which is being rotated. The amount of sealant to be dispensed may be adjusted at this time upon a turning of control knob 29. At the wiping station, the coated threads are wiped by belt 83 and the sealant is firmly pressed into the thread roots to fill any and all voids in the threads to provide consistently leak-proof coatings.

The table is indexed through 60° arcs in a continuous manner for the remaining articles supported thereon after the completion of the dispensing and wiping operations as aforedescribed. The six threaded articles may be coated more than once if necessary and, after they move beyond the wiping station, the coated articles are unloaded from the worktable and replaced with new articles to be coated.

Obviously, many other modifications and variations of the present invention are made possible in light of the above teachings. It is therefore to be understood that within the scope of the appended claims the invention may be practiced otherwise than specifically described.

What is claimed is:

1. An apparatus for applying sealant to the threads of article such as fasteners, pipes, plugs, valves, etc. comprising:

rotatable means for moving a plurality of threaded fasteners along an arcuate path;

nozzle means adjacent said path for dispensing a coating of sealant on to threads of articles moved along said path;

said rotatable means comprising an indexable worktable having a plurality of fastener spindle assemblies radially spaced a predetermined distance apart and located adjacent the periphery thereof, said worktable being capable of intermittent stoppage of each of said assemblies at said nozzle mean;

means rotating each said spindle assembly about the central axis thereof when stopped at said nozzle means;

wiper means, positioned to wipe the article threads, comprising a wiper wheel adjacent said path and spaced from said nozzle means at said predetermined distance, a wiper pad positioned along the peripheral edge of said wheel; and means rotating said wiper wheel to effect rotation of each said spindle about said central axis thereof when stopped at said wiper means;

whereby the coated threads are wiped and smoothened as sealant is pressed into the thread roots.

2. The apparatus according to claim 1, wherein said means for rotating each said spindle assembly comprises a first disc of magnetic material mounted on each said spindle assembly for rotation therewith, and a second disc of magnetic material in said path mounted for rotation and spaced a slight distance from each said first disc upon stoppage of said spindle assembly at said nozzle means, rotation of said second disc effecting rotation of said stopped spindle assembly via magnetic attraction between said first and second discs.

3. The apparatus according to claim 1, wherein means are provided for adjusting said nozzle means relative to said stopped spindle assemblies.

4. The apparatus according to claim 1, further comprising a sealant dispensing pump associated with said nozzle means, and means for actuating said pump for dispensing sealant from said nozzle means as each said spindle assembly is stopped thereat.

5. The apparatus according to claim 4, wherein said actuating means comprising a switch arm extending toward said worktable into said path for movement by each article before being stopped at said nozzle means.

6. An apparatus for sealant coating the threads of articles such as fasteners, pipes, plugs, valves, fittings, etc., comprising:

article support means for intermittently moving a plurality of articles, along an arcuate path;

rotatable article spindle assemblies on said support means spaced apart a predetermined distance and being intermittently stopped at a dispensing station and at a wiping station spaced apart said predetermined distance;

nozzle means adjacent said path at said dispensing station for dispensing a coating of sealant on to the article threads; and wiper means adjacent said path at said wiping station threads; and wiper means adjacent said path at said wiping station for wiping the coated threads and for pressing the coated sealant into the thread roots, said wiper means comprising a rotatable wiper wheel having a peripheral wiper pad for rotating the fasteners upon wiper wheel rotation.

7. The apparatus according to claim 6, wherein means are provided for rotating each said spindle assembly when stopped at said dispensing station to effect the coating of sealant along at least a portion of the thread circumference.

8. The apparatus according to claim 7, wherein said rotating means comprises a rotatable magnetic first disc at said dispensing station, and a magnetic second disc associated with each said rotatable spindle assembly, rotation of said first disc effecting rotation by magnetic attraction of each said second disc when stopped at said dispensing station.

9. The apparatus according to claim 6, wherein a dispensing pump is provided for feeding sealant into said nozzle means, and switch means for actuating the dispensing of sealant.

10. The apparatus according to claim 9, wherein said switch means comprises a switch arm extending into said path for actuation by each article before being stopped at said dispensing station.

* * * * *